US011608584B1

(12) United States Patent
Valdes et al.

(10) Patent No.: US 11,608,584 B1
(45) Date of Patent: Mar. 21, 2023

(54) DRYING DEVICE AND METHODS OF MAKING AND USING THE SAME

(71) Applicants: Carlos Valdes, Raleigh, NC (US); Emily Valdes, Raleigh, NC (US)

(72) Inventors: Carlos Valdes, Raleigh, NC (US); Emily Valdes, Raleigh, NC (US)

( * ) Notice: Subject to any disclaimer, the term of this patent is extended or adjusted under 35 U.S.C. 154(b) by 0 days.

(21) Appl. No.: 17/741,084

(22) Filed: May 10, 2022

(51) Int. Cl.
*D06F 58/20* (2006.01)
*D06F 57/12* (2006.01)
*D06F 59/00* (2006.01)

(52) U.S. Cl.
CPC ..... *D06F 57/122* (2013.01); *D06F 58/20* (2013.01); *D06F 59/00* (2013.01)

(58) Field of Classification Search
CPC ..... D06F 57/122; D06F 58/20; D06F 59/00; D06F 59/02
USPC ..... 34/440, 439, 437
See application file for complete search history.

(56) References Cited

U.S. PATENT DOCUMENTS 5,398,428 A * 3/1995 Wallace ..... D06F 58/04 34/104
6,732,447 B2 * 5/2004 Tomasi ..... D06F 58/04 34/106
11,486,085 B2 * 11/2022 Erickson ..... D06F 58/20

FOREIGN PATENT DOCUMENTS

CN 102108615 A * 6/2011
CN 203613403 U * 5/2014

* cited by examiner

*Primary Examiner* — John P McCormack
(74) *Attorney, Agent, or Firm* — Dogwood Patent and Trademark Law; Ashley D. Johnson

(57) ABSTRACT

The invention is directed to a drying device comprising a base with arms adjustably attached to each end. The arms each include an internal spring that allows the arms to adapt to a wide variety of dryers of different shapes, sizes, and models. The distal end of each arm also includes an attachment that is sized and shaped to fit into the interior of an item of footwear. Each attachment includes a plurality of apertures that promote air flow into the interior of the footwear when in use. In this way, the footwear remains compressed on the walls of the drying device. After the drying cycle has been completed, the footwear is dried on the exterior and interior surface.

18 Claims, 8 Drawing Sheets

DRYING DEVICE AND METHODS OF MAKING AND USING THE SAME

TECHNICAL FIELD

The presently disclosed subject matter relates generally to a drying device, such as a device for drying footwear in a conventional clothes dryer. The method also includes methods of making and using the disclosed device.

BACKGROUND

Various types of drying devices are known in the art. For example, clothes dryers are commonly used to dry wet clothing after they have been washed. Automatic clothes dryers typically include a rotating drum operatively connected to a heat source. During drying, heat is introduced into the rotating drum using a fan or a blower to dry the wet items. Footwear is often washed in a conventional washing machine or by hand to remove dirt and stains. However, when footwear is placed into the drum of a conventional dryer, the shoes tumble against the walls of the drum causing a loud and distracting noise. In addition, the force from the tumbling shoes can oftentimes knock open the door to the dryer, leaving the items inside damp or wet. The repetitive tumbling motion can also damage footwear placed in the dryer. When the dryer cycle has finished, footwear often is not fully dry, especially on the interior portion. The footwear must then be air dried, which takes additional time. Alternatively, the footwear can be placed again in the dryer for a longer period of time, which wastes energy and restarts the loud and distracting noise. It would therefore be beneficial to provide a drying device that overcomes the shortcomings of the prior art.

SUMMARY

In some embodiments, the presently disclosed subject matter is directed to a drying device. The device comprises a hollow tubular base defined by a first base end, a second base end, first and second aligned holes positioned adjacent to each of the first and second base ends, and an interior channel that spans the distance from the first base end to the second base end. The device also includes a separator positioned within a midpoint of the base interior channel, wherein the separator is defined by a first separator end and a second separator end. The device includes a first spring positioned within the base interior channel, with a first spring end adjacent to the first separator end and a second spring end adjacent to the first end of the base. The device comprises a second spring positioned within the base interior channel, with a first spring end adjacent to the second separator end; and a second spring end adjacent to the second end of the base. The device includes a first arm and a second arm, each arm defined by a first arm end, a second arm end comprising an attachment sized and shaped to fit within a footwear interior, an interior channel that spans the distance from the first arm end to the second arm end, and a sliding pin element comprising a length and a locking notch. The first end of the first arm is positioned within the interior channel of the base, adjacent to the second end of the first spring; and the second end of the first arm is exterior to the base interior channel. The first end of the second arm is positioned within the interior channel of the base, adjacent to the second end of the second spring, and the second end of the second arm is exterior to the base interior channel. The first and second arms slide relative to the base interior channel.

In some embodiments, the base tapers at the first end or second end.

In some embodiments, the base broadens at the first end or second end.

In some embodiments, the sliding pin element is L-shaped.

In some embodiments, the attachments are releasably attached to the second end of each arm.

In some embodiments, each attachment is defined by a toe region, middle section, and heel region, and wherein the toe region includes a hole positioned at the toe region and a plurality of relatively smaller holes positioned at the middle section.

In some embodiments, the separator is permanently attached to base interior channel.

In some embodiments, the separator can move within the base interior channel.

In some embodiments, the first and second arms have a length of about 5-25 inches, a width of about 0.1-5 inches, and a thickness of about 0.1-5 inches.

In some embodiments, the base has a length of about 10-50 inches, a width of about 0.1-5 inches, and a thickness of about 0.1-5 inches.

In some embodiments, the presently disclosed subject matter is directed to a method of drying footwear. The method comprises positioning an item of footwear over an attachment of the disclosed drying device. The method includes pushing the second ends of the arms inward, toward the base. The method includes placing the device within the interior of a dryer comprising an interior drum and a series of drum walls. The method comprises releasing the arms, wherein the springs allow the arms to engage the walls of the drum, thereby retaining the footwear against the walls of the drum. The method includes initiating the drying cycle of the drying device, whereby the drum spins and the device is retained on the walls of the drum during spinning, whereby the footwear is dried.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1A:
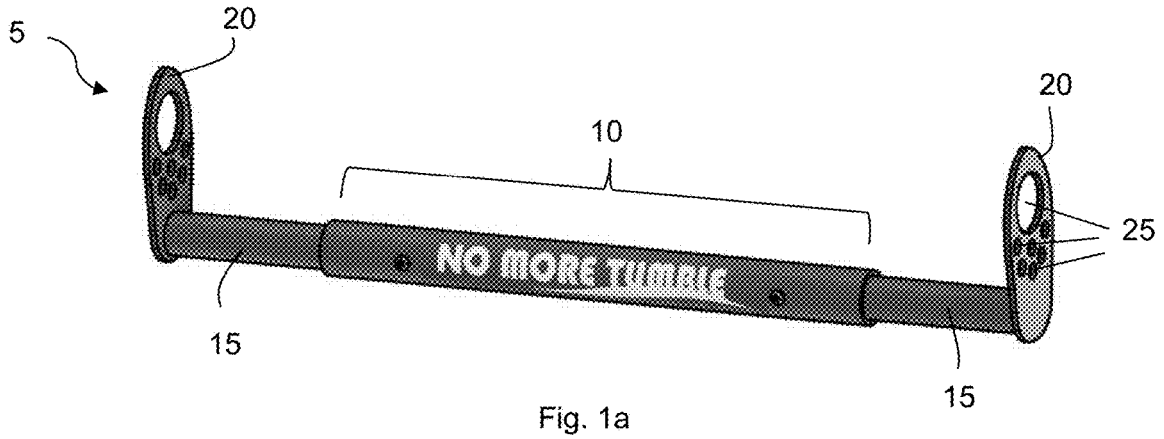
FIG. 1*a* is a front perspective view of a drying device in accordance with some embodiments of the presently disclosed subject matter.
Figure 1B:
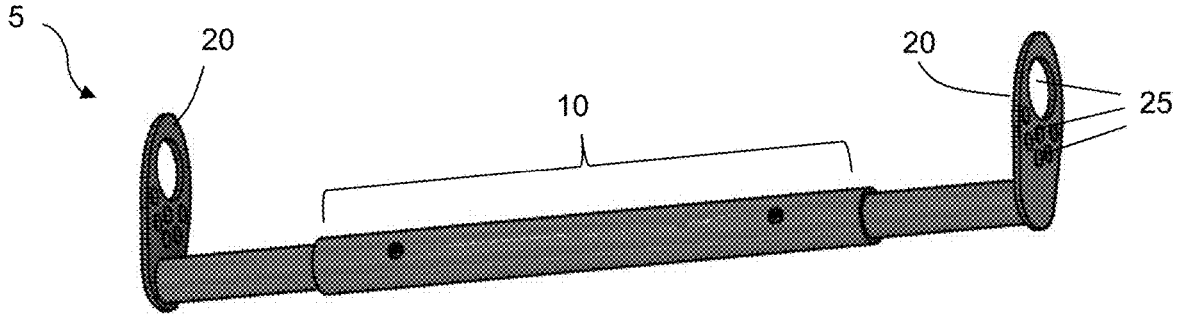
FIG. 1*b* is a rear perspective view of a drying device in accordance with some embodiments of the presently disclosed subject matter.

FIGS. 1*a* and 1*b* illustrate one embodiment of drying device 5. As shown, the device comprises base 10 with arms 15 adjustably attached to each end. The arms include an internal spring that allows the arms to adapt to a wide variety of dryers of different shapes, sizes, and models. The distal end of each arm also includes attachment 20 that is sized and shaped to fit into the interior of an item of footwear. Each attachment includes a plurality of apertures 25 that promote air flow into the interior of the footwear when in use. The term "footwear" broadly includes any item of apparel that is worn on the foot of a user, such as (but not limited to) running shoes, boots, shoes, sandals, boat shoes, slippers, hiking shoes, and the like.

Figure 2A:
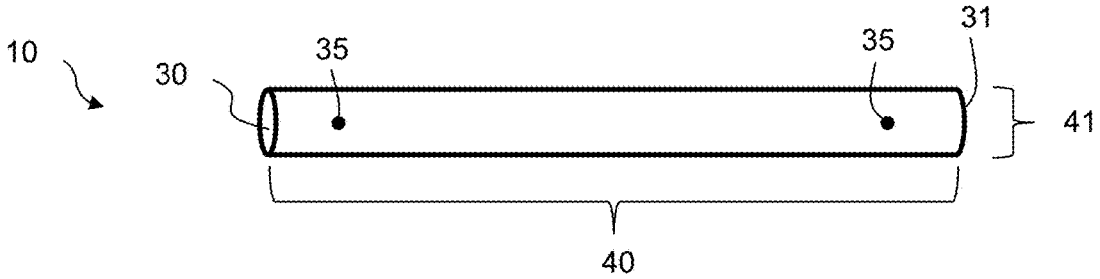
FIG. 2*a* is a front perspective view of a device base in accordance with some embodiments of the presently disclosed subject matter.
Figure 2B:
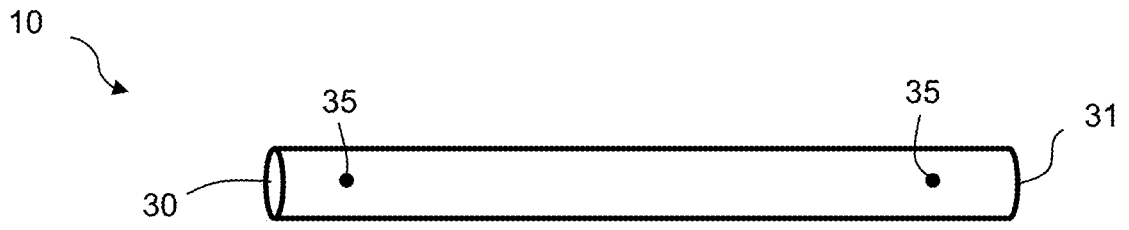
FIG. 2*b* is a rear perspective view of a device base in accordance with some embodiments of the presently disclosed subject matter.

As set forth above, the disclosed device includes tubular base 10 positioned in the central portion of device 5. One embodiment of base 10 is illustrated in FIGS. 2*a* and 2*b*. As shown, the base includes first end 30 and opposed second end 31 with a length therebetween. The base also includes a pair of holes 35 positioned adjacent to each end 30, 31 on both the front and rear side. The term "hole" refers to an opening that extends through the thickness of the base. Although depicted as round in the Figures, holes 35 can be configured in any desired shape. The holes cooperate to maintain the arms on the base, as discussed in detail below. The holes can be positioned about 1-5 inches from each end 30, 31 (e.g., at least/no more than about 1, 1.5, 2, 2.5, 3, 3.5, 4, 4.5, or 5 inches).

Figure 3:
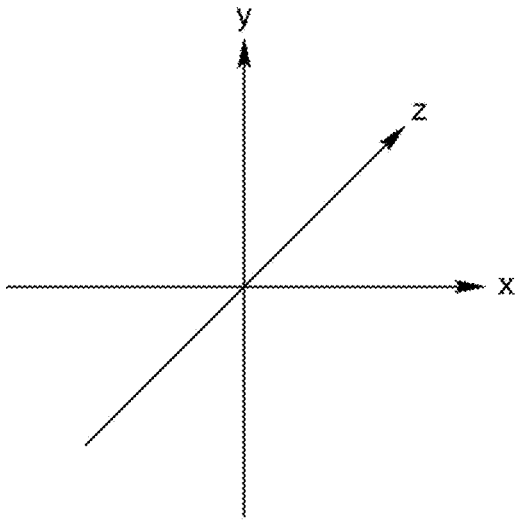
FIG. 3 is a representation of x, y, and z axes in accordance with some embodiments of the presently disclosed subject matter.

The base can have length 40 of about 10-50 inches (e.g., at least/no more than about 10, 15, 20, 25, 30, 35, 40, 45, or 50 inches). The term "length" refers to the dimension in the longitudinal direction of the device, e.g., the distance between first end 31 and second end 32. Base 10 can further include width 41 and thickness 42 of about 0.1-5 inches (e.g., at least/no more than about 0.1, 0.5, 1, 1.5, 2, 2.5, 3, 3.5, 4, 4.5, or 5 inches). The term "width" refers to the longest straight line distance perpendicular to the length. The term "thickness" refers to the distance across the widest portion of the device. In some embodiments, the "length" refers to the distance substantially along the x-axis, the "width" refers to the distance substantially along the y-axis, and the "thickness" refers to the distance substantially along the z-axis, as shown in FIG. 3.

Figure 4A:
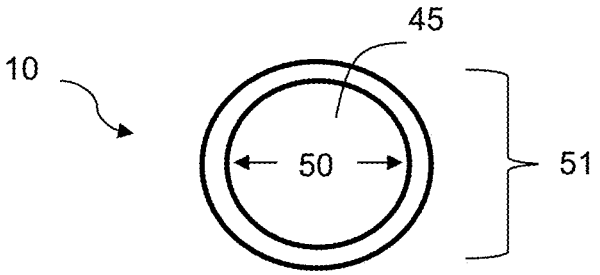
FIG. 4*a* is a cross-sectional view of a device base in accordance with some embodiments of the presently disclosed subject matter.
Figure 4B:
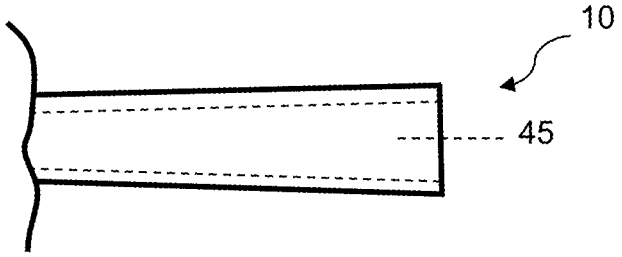
FIGS. 4*b* and 4*c* are fragmentary views illustrating device bases with non-uniform widths in accordance with some embodiments of the presently disclosed subject matter.
Figure 4C:
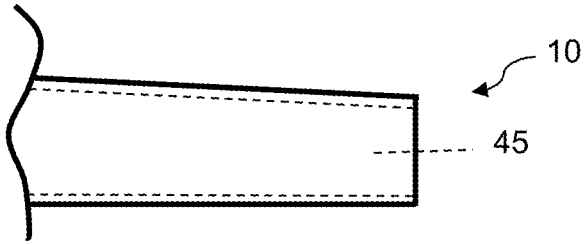

Base 10 includes interior channel 45 that spans the distance between first and second ends 31, 32, as shown in FIG. 4*a*. The interior channel can include diameter 50 of about 0.1-5 inches (e.g., at least/no more than about 0.1, 0.5, 1, 1.5, 2, 2.5, 3, 3.5, 4, 4.5, or 5 inches). It should be appreciated that the interior channel diameter is slightly less than outer diameter 51 of the base (e.g., about 0.1, 0.5, 1, 2, 3, 4, 5, 10, 15, or 20 percent less in some embodiments). The term "diameter" refers to the longest distance passing through the midpoint of the cross-section. The inner and outer diameter of the base can be uniform from first end 31 to second end 32. Alternatively, the first and second ends of the base can taper or broaden, such as to retain the arms more effectively on the base and/or to stabilize the base during use, as illustrated in the embodiments of FIGS. 4*b* and 4*c*.

Base 10 can have any desired cross-sectional shape, such as (but not limited to) circular, oval, square, rectangular, triangular, pentagonal, hexagonal, octagonal, and the like. It should be appreciated that any shape can be used.

Figure 5A:
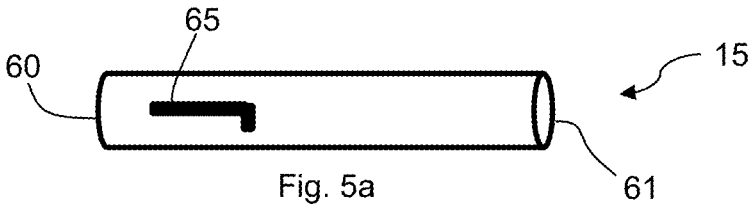
FIG. 5*a* is a perspective view of a device arm in accordance with some embodiments of the presently disclosed subject matter.

As set forth above, base 10 further includes hollow cylindrical arms 15 positioned at first and second ends 31, 32. The arms are operatively connected to the base at opposite ends. As shown in FIG. 5*a*, each arm includes first and second ends 60, 61 and a length therebetween. The arms also include locking notch 65 positioned at first end 60. In some embodiments, the locking notch has an "L" shape, as shown. The locking notch can be positioned about 0.1-3 inches from the first end (e.g., at least/no more than about 0.1, 0.5, 1, 1.5, 2, 2.5, or 3 inches from the first end). The locking notch allows each arm to be slidably connected to base 10 (e.g., the respective arm can slide into the hollow interior of the base). The locking notch also prevents each arm from sliding completely out of the base.

The locking notch can be formed in arms 15 using any known method, such as (but not limited to) laser cutting, mechanical cutting devices (blades, drills, saws, etc.), water cutting, and the like.

Figure 5B:
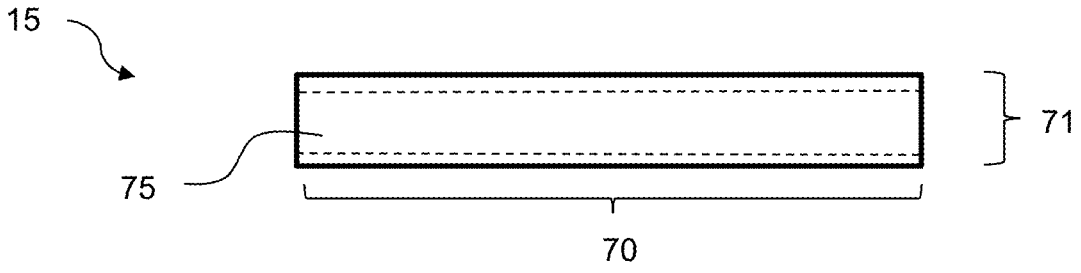
FIG. 5*b* is a side view of a device arm in accordance with some embodiments of the presently disclosed subject matter.
Figure 5C:
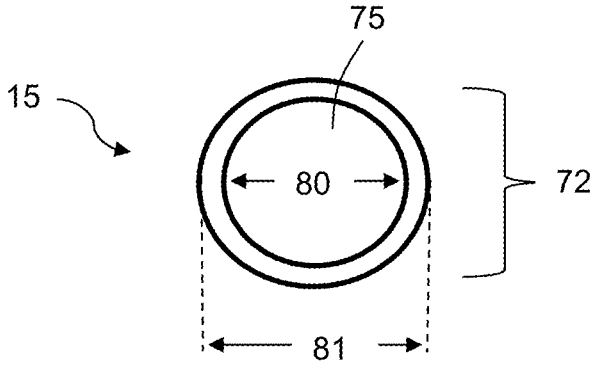
FIG. 5*c* is a cross-sectional view of a device arm in accordance with some embodiments of the presently disclosed subject matter.

Arms 15 can have length 70 of about 5-25 inches (e.g., at least/no more than about 5, 10, 15, 20, or 25 inches). Arms 15 can further include width 71 and thickness 72 of about 0.1-5 inches (e.g., at least/no more than about 0.1, 0.5, 1, 1.5, 2, 2.5, 3, 3.5, 4, 4.5, or 5 inches), as shown in FIGS. 5*b* and 5*c*.

Each arm includes interior channel 75 that spans the distance between first and second ends 60, 61. The interior channel can include diameter 80 of about 0.1-5 inches (e.g., at least/no more than about 0.1, 0.5, 1, 1.5, 2, 2.5, 3, 3.5, 4, 4.5, or 5 inches). It should be appreciated that the interior channel diameter is slightly less than outer diameter 81 of the arm. The inner and outer diameter of the arms can be uniform from first end 60 to second end 61. Alternatively, the first and second ends of each arm can taper or broaden, such as to retain the arms more effectively on the base and/or to stabilize the device during use, as shown in FIGS. 4*b* and 4*c* for the base Arms 15 can have any desired cross-sectional shape, such as (but not limited to) circular, oval, square, rectangular, triangular, pentagonal, hexagonal, octagonal, and the like. Any shape can be used, although the shape of the arms is configured to allow the first end of each arm to fit within the interior channel of the base.

Base 10 and arms 15 can be constructed from any rigid material. The term "rigid material" refers to any material that provides structure or hardness to the element, maintaining its shape or form (e.g., not easily flexible, bendable, or malleable). Thus, the disclosed device base and arms can be constructed from one or more polymeric materials (e.g., high density polyethylene, polypropylene, etc.), wood, and/or metals (stainless steel, steel, aluminum, platinum, copper, etc.). In some embodiments, combinations of the cited materials can be used.

As set forth above, attachment 20 is configured at second end 61 of each arm. In some embodiments, the attachments are permanently configured on the arms using conventional mechanisms, such as the use of adhesive, welding, and the like. In other embodiments, the attachments are removably attached to second end 61, through the use of snap-fit attachment, pressure fit attachment, magnets, ties, fasteners, screws, and the like.

Figure 6A:
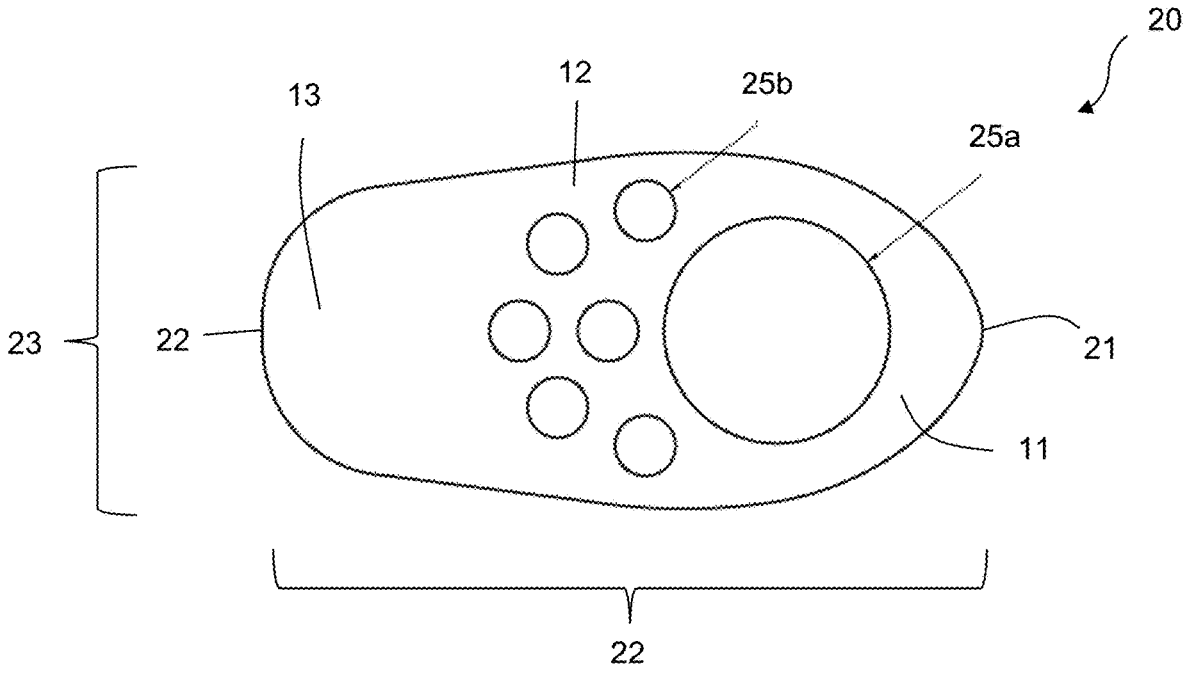
FIG. 6*a* is a top plan view of a device attachment in accordance with some embodiments of the presently disclosed subject matter.
Figure 6B:
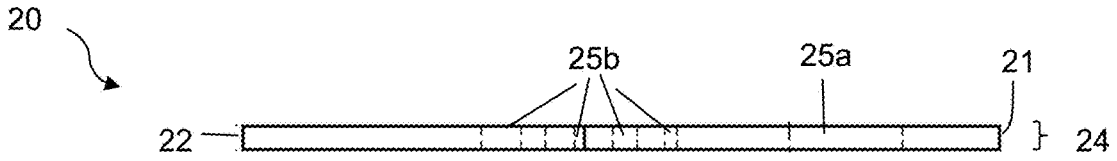
FIG. 6*b* is a side plan view of a device attachment in accordance with some embodiments of the presently disclosed subject matter.

One embodiment of attachment 20 is illustrated in FIGS. 6*a* and 6*b*. As shown, the attachment can take the shape of a shoe form, with a tapered toe 11, wider middle section 12, and rounded heel 13. However, any shape can be used. Attachment 20 can have any suitable length 22, width 23 (e.g., at least/no more than about 2, 3, 4, 5, 6, 7, 8, 9, or 10 inches) or thickness 24 (e.g., at least/no more than about 0.1, 0.5, 1, 1.5, 2, 2.5, 3, 3.5, 4, 4.5, or 5 inches).

It has been found that configurations of the attachment with a single large aperture (e.g., with a diameter of about 0.5, 1, 2, 3, 4, or 5 inches) toward first end 21 of the attachment, followed by a series of smaller apertures 25*b* (e.g., with a diameter of about 0.1-0.2, 0.3, 0.4, 0.5, 0.6, 0.7, 0.8, 0.9, or 1 inch) at the middle portion of the attachment, and no apertures at second end 22 of the attachment provides for maximum drying of the shoe interior when the device is in use. Specifically, large hole 25*a* allows for maximum air flow through the toe and middle portion of the shoe interior. The air can flow above, below, around, and through the large hole. The smaller holes 25*b* serve to direct the air flow to into smaller currents of air to sufficiently dry the middle portion of the shoe. The second end has no holes because this end is typically the easiest to dry, having access to the direct dryer air flow when the device is in use (e.g., the arms attach to the attachment in this area).

Figure 7A:
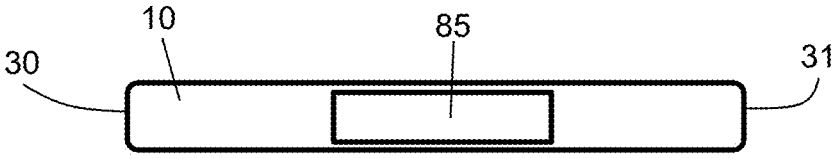
FIG. 7*a* is a side plan view of a separator positioned within the interior of a device base in accordance with some embodiments of the presently disclosed subject matter.
Figure 7B:
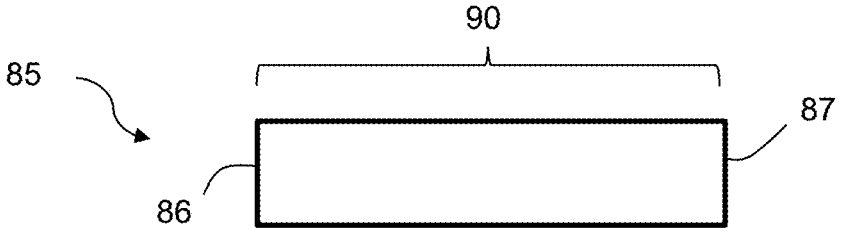
FIG. 7*b* is a side view of a device separator in accordance with some embodiments of the presently disclosed subject matter.

As shown in FIGS. 7*a* and 7*b*, the interior channel of base 10 further includes separator 85 positioned in the approximate center of the base (e.g., equidistance from the first and second ends of the base). The separator includes first end 86 and opposed second end 87. In some embodiments, the separator is permanently positioned into the center of the base, using standard techniques such as adhesive, welding, thermoforming, and the like. In other embodiments, the separator is allowed movement within the interior channel of the base (e.g., to adjust during movement of the dryer when in use).

The separator can include length 90 of about 1-10 inches (e.g., at least/no more than about 1, 2, 3, 4, 5, 6, 7, 8, 9, or 10 inches). The separator can be solid (e.g., configured without an interior channel). The separator has width and thickness that are slightly less than the length and width of the base (e.g., about 0.1, 1, 2, 3, 4, 5, 6, 7, 8, 9, or 10 percent less). In this way, the separator is accommodated within the interior channel of the base and resists excessive movement.

The separator can be constructed from any rigid material (e.g., wood, plastic, metal, and combinations thereof).

Figure 8A:
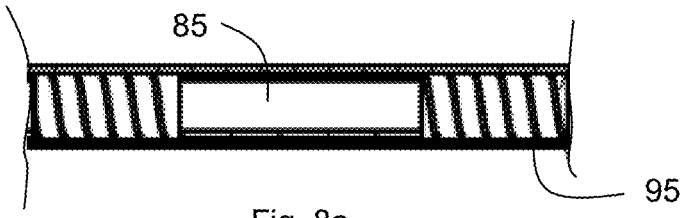
FIG. 8*a* is a side view of a separator and adjacent springs positioned within a device base in accordance with some embodiments of the presently disclosed subject matter.
Figure 8B:
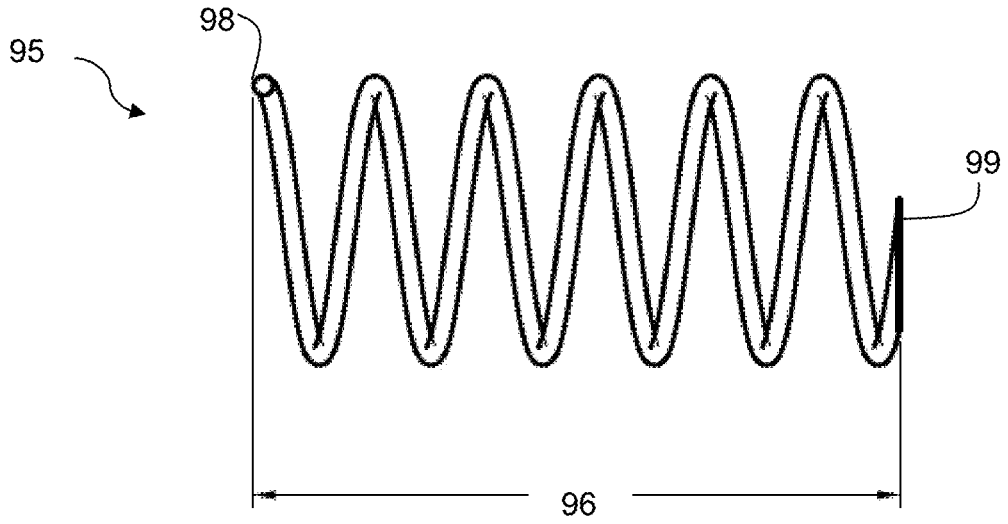
FIG. 8*b* is a side view of a device spring in accordance with some embodiments of the presently disclosed subject matter.

A pair of springs 95 are positioned on either side of the separator, within the interior channel of the base, as shown in FIG. 8*a*. The term "spring" refers to any component capable of regaining its normal shape after removal of a stress. The term "spring" can therefore include coil springs, leaf springs, face spring, and other springs known in the art. Each spring exerts an outward force against each of the arms 15. As a result, the arms can be slidably pushed into base 10 against the force of the spring.

Spring 95 can have length 96 of about 1-10 inches at rest (e.g., about 1, 2, 3, 4, 5, 6, 7, 8, 9, or 10 inches), as shown in FIG. 6*b*. Each spring also includes first and second ends 98, 99. One end of each spring is positioned directly adjacent to the separator, while the other end is positioned at or near end 60 of each arm.

The disclosed device can have any desired weight, such as (but not limited to) about 1-15 pounds (e.g., at least about or no more than about 1, 2, 3, 4, 5, 6, 7, 8, 9, 10, 11, 12, 13, 14, or 15 pounds). However, it should be appreciated that device 5 can be constructed to have a weight that is outside the range set forth above.

Device 5 can be constructed using any known method, such as extrusion, injection molding, compression molding, welding, and the like.

Figure 9A:
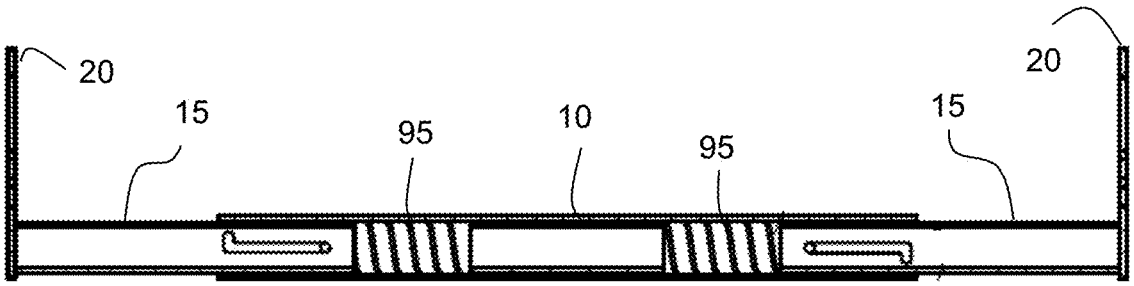
FIG. 9*a* is a side view of an assembled drying device in accordance with some embodiments of the presently disclosed subject matter.
Figure 9B:
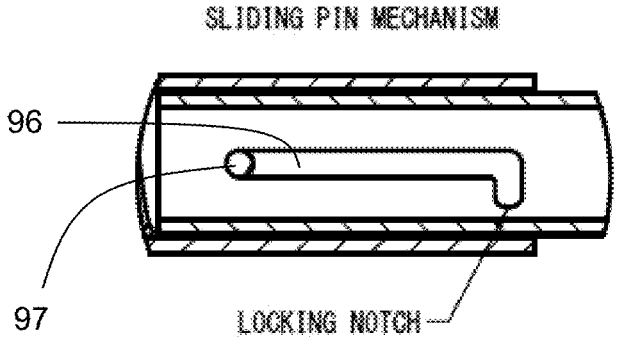
FIG. 9*b* is a fragmentary view of a device locking notch in accordance with some embodiments of the presently disclosed subject matter.

In use, the disclosed device can be assembled by positioning attachment 20 at second end 32 of each arm 15. The attachments can be clipped, fastened, etc. to the arms. The first end of each arm is then positioned within the interior channel of base 10, as illustrated in FIG. 9*a*. The arms are maintained within the base by passing a bolt or screw through holes 35 (e.g., through the base hole on the front face, passing through the locking notch, and out thorough the opposed hole on the rear face of the base). This is repeated at both ends of the device (e.g., in both arms). A sliding pin mechanism allows the arms to be configured within the interior passageway of the base, yet also allows the arms to move toward and away from the separator via springs 95, as shown in FIG. 9*b*. Specifically, length 96 of the locking notch allows a bolt or screw 97 to travel down the length, which maintains the device in position on the interior of a drum. The steps can be completed in any order.

Figure 10:
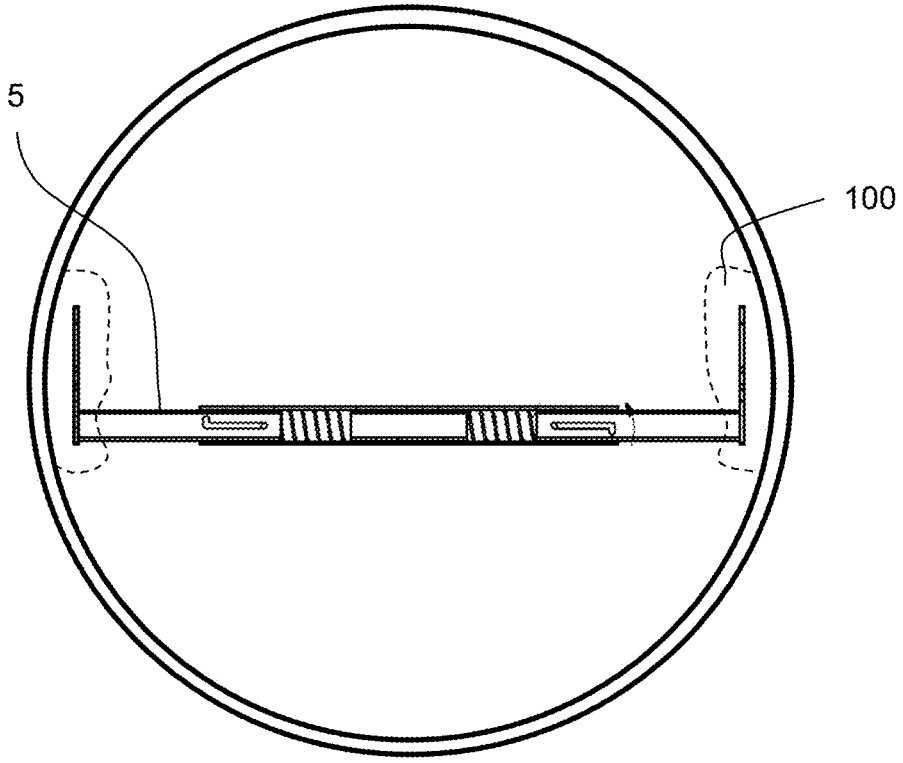
FIG. 10 is a front view of a device configured in a standard clothes dryer in accordance with some embodiments of the presently disclosed subject matter.

A user can insert one shoe 100 on each end of the device, fitting over the attachments. With the two shoes in place, the arms can be pushed in against the force of the springs, and device 5 can be placed int the drum of a drying device. Spring 95 allows the arm to move toward separator 90, which in turn decreases the length of the device as a portion of one or both arms slide within the interior channel of the base. The arms can move independently of each other. The device can then be positioned in the drum of a conventional dryer. When the arms are released in the drum, the outward force exerted by springs 95 causes the arms to engage the walls of the drum with the shoes being lightly pushed against the drum walls. The device and shoes are held in position due to the tension provided by springs 95, as shown in FIG. 10. The dryer can then be activated and as the drum turns, so does device 5 and the shoes retained on the end of the attachment are fully dried at the end of the cycle. The shoes are held in place despite the rotation of the drum and the movement of other items (e.g., clothing) that may be present in the drum.

As the drum rotates, the device moves through a circular path having a diameter that is about the same as the drum. Centrifugal force acts on the air molecules in the device near openings 25 in the attachments.

It should be appreciated that device 5 can be used in a range of drum sizes of different brands and models of drying devices. Because the arms can be pushed inward via springs 95, the arms can both smaller and larger appliances.

When the drying cycle is complete, the user can apply a pressure to one end of the device, moving an arm towards a separator to decrease the device length. In doing so, the device is no longer retained between two opposing walls of the dryer drum. The user can then remove the device, remove the shoes from the attachments, and wear the dried footwear.

The disclosed device offers many advantages over the prior art. For example, the dual spring configuration allows the arms to move together or independently, thereby providing a more secure hold when positioned within the dryer drum. For example, if one spring fails, the other will react and hold the device in place.

The unique hole configuration in the attachment promotes efficient drying of footwear. Specifically, the holes facilitate convection air to flow through the interior of the footwear, thereby drying the item more evenly on the interior and exterior.

The disclosed device is easy to use, such that even children and the elderly can effectively install and use the device.

Device 5 is resilient, allowing the user to make use of the device for many years without breaking or requiring replacement.

The disclosed device is adjustable, such that it can be accommodated in drums of most (if not all) drying devices and can further accommodate footwear of different sizes and types.

Advantageously, the first and second arms can operate independently from one another since each has its own spring.

The device can further dry footwear without incurring a loud and distracting noise form the shoes tumbling on the drum interior.

The disclosed device protects footwear, keeping them from banging around and becoming damaged during drying.

Further, the disclosed device can be economically produced, allowing for most consumers to be able to afford and use the device.

These and other advantages would be apparent to those of ordinary skill in the art after a review of the presently disclosed subject matter.

What is claimed is:

1. A drying device comprising:

a hollow tubular base defined by:
- a first base end;
- a second base end;
- first and second aligned holes positioned adjacent to each of the first and second base ends; and
- an interior channel that spans the distance from the first base end to the second base end;

a separator positioned within a midpoint of the base interior channel, wherein the separator is defined by a first separator end and a second separator end;

a first spring positioned within the base interior channel, with a first spring end adjacent to the first separator end and a second spring end adjacent to the first end of the base;

a second spring positioned within the base interior channel, with a first spring end adjacent to the second separator end; and a second spring end adjacent to the second end of the base;

a first arm and a second arm, each arm defined by:
- a first arm end;
- a second arm end comprising an attachment sized and shaped to fit within a footwear interior;
- an interior channel that spans the distance from the first arm end to the second arm end;
- a sliding pin element comprising a length and a locking notch;
- wherein the first end of the first arm is positioned within the interior channel of the base, adjacent to the second end of the first spring; and the second end of the first arm is exterior to the base interior channel;
- wherein the first end of the second arm is positioned within the interior channel of the base, adjacent to the second end of the second spring, and the second end of the second arm is exterior to the base interior channel;
- wherein the first and second arms slide relative to the base interior channel; and wherein each attachment is defined by a toe region, middle section, and heel region, and wherein the toe region includes a hole positioned at the toe region and a plurality of relatively smaller holes positioned at the middle section.

2. The drying device of claim 1, wherein the base tapers at the first end or second end.

3. The drying device of claim 1, wherein the base broadens at the first end or second end.

4. The drying device of claim 1, wherein the sliding pin element is L-shaped.

5. The drying device of claim 1, wherein the attachments are releasably attached to the second end of each arm.

6. The drying device of claim 1, wherein the separator is permanently attached to base interior channel.

7. The drying device of claim 1, wherein the separator moves within the base interior channel.

8. The drying device of claim 1, wherein the first and second arms have a length of about 5-25 inches, a width of about 0.1-5 inches, and a thickness of about 0.1-5 inches.

9. The drying device of claim 1, wherein the base has a length of about 10-50 inches, a width of about 0.1-5 inches, and a thickness of about 0.1-5 inches.

10. A method of drying footwear, the method comprising:

positioning an item of footwear over an attachment of the drying device of claim 1, the drying device defined as:

a hollow tubular base defined by:

a first base end;

a second base end;

first and second aligned holes positioned adjacent to each of the first and second base ends; and an interior channel that spans the distance from the first base end to the second base end;

a separator positioned within a midpoint of the base interior channel, wherein the separator is defined by a first separator end and a second separator end;

a first spring positioned within the base interior channel, with a first spring end adjacent to the first separator end and a second spring end adjacent to the first end of the base;

a second spring positioned within the base interior channel, with a first spring end adjacent to the second separator end; and a second spring end adjacent to the second end of the base;

a first arm and a second arm, each arm defined by:

a first arm end;

a second arm end comprising an attachment sized and shaped to fit within a footwear interior;

an interior channel that spans the distance from the first arm end to the second arm end;

a sliding pin element comprising a length and a locking notch;

wherein the first end of the first arm is positioned within the interior channel of the base, adjacent to the second end of the first spring; and the second end of the first arm is exterior to the base interior channel;

wherein the first end of the second arm is positioned within the interior channel of the base, adjacent to the second end of the second spring, and the second end of the second arm is exterior to the base interior channel;

wherein the first and second arms slide relative to the base interior channel pushing the second ends of the arms inward, toward the base;

placing the device within the interior of a dryer with an interior drum comprising walls;

releasing the arms, wherein the springs allow the arms to engage the walls of the drum, thereby retaining the footwear against the walls of the drum;

initiating the drying cycle of the drying device, whereby the drum spins and the device is retained on the walls of the drum during spinning;

whereby the footwear is dried; and wherein each attachment is defined by a toe region, middle section, and heel region, and wherein the toe region includes a hole positioned at the toe region and a plurality of relatively smaller holes positioned at the middle section.

11. The method of claim 10, wherein the base tapers at the first end or second end.

12. The method of claim 10, wherein the base broadens at the first end or second end.

13. The method of claim 10, wherein the sliding pin element is L-shaped.

14. The method of claim 10, wherein the attachments are releasably attached to the second end of each arm.

15. The method of claim 10, wherein the separator is permanently attached to base interior channel.

16. The method of claim 10, wherein the separator moves within the base interior channel.

17. The method of claim 10, wherein the base has a length of about 10-50 inches, a width of about 0.1-5 inches, and a thickness of about 0.1-5 inches.

18. The method of claim 10, wherein the dryer is a clothes dryer.

* * * * *